US006503691B1

(12) United States Patent
Goodin et al.

(10) Patent No.: US 6,503,691 B1
(45) Date of Patent: Jan. 7, 2003

(54) POLYMER SYSTEM WITH SWITCHABLE PHYSICAL PROPERTIES AND ITS USE IN DIRECT EXPOSURE PRINTING PLATES

(75) Inventors: Jonathan William Goodin, Delta (CA); Jon Alfred Bjork, Vancouver (CA); David A. Morgan, Stillwater, MN (US); Livia Tatiana Memetea, Vancouver (CA); Yisong Yu, Vancouver (CA)

(73) Assignee: Creo SRL, St. James (BB)

( * ) Notice: Subject to any disclaimer, the term of this patent is extended or adjusted under 35 U.S.C. 154(b) by 0 days.

(21) Appl. No.: 09/465,658

(22) Filed: Dec. 17, 1999

(51) Int. Cl.[7] ..... G03C 1/77; G03C 1/73; G03C 1/74; G03C 5/56

(52) U.S. Cl. ..... 430/278.1; 430/271.1; 430/286.1; 430/287.1; 430/288.1; 430/302; 430/303

(58) Field of Search ..... 430/302, 303, 430/271.1, 286.1, 278.1, 287.1, 288.1; 522/126

(56) References Cited

U.S. PATENT DOCUMENTS 5,565,212 A * 10/1996 Yokomori et al. ..... 424/438
5,846,381 A * 12/1998 Wirth et al. ..... 427/121
6,132,822 A * 10/2000 Overcash et al. ..... 428/34.2

FOREIGN PATENT DOCUMENTS

JP 9-100371 * 4/1997

OTHER PUBLICATIONS

Akashi et al. JPAB Pub No. JP409100371 A—English abstract of JP 9–100371 published on Apr. 15, 1997.*

* cited by examiner

*Primary Examiner*—Janet Baxter
*Assistant Examiner*—Sin J. Lee
(74) *Attorney, Agent, or Firm*—Mark A. Litman & Assoc. P.A.

(57) ABSTRACT

Polymer materials are described that undergo a 2-level 3 dimensional crosslinking process. During this process, hydrophilic polymers are crosslinked at two levels, the first results in a low level of crosslinking which leads to a toughening of the layer preventing dissolution by the fountain solution but with the layer remaining hydrophilic. The second level of crosslinking is higher and is the result of exposure to a laser diode thermal imaging device. The crosslinking at this second level results in a loss of hydrophilicity and provides instead an oleophilic image capable of accepting and transferring oil based ink. The polymer materials are particularly useful in lithographic printing systems where they may used in articles such as a printing plate comprising a substrate having coated thereon a layer that becomes that becomes less hydrophilic upon exposure to thermal energy (e.g., heat, particularly heat applied by a laser, other columnated light, or thermal printhead) that effects crosslinking (initial crosslinking or increased crosslinking) in the layer, the layer comprising a mixture of a crosslinked polymer and a thermally active crosslinking metal compound (e.g., a metal salt, metal ester or metal oxide).

12 Claims, No Drawings

POLYMER SYSTEM WITH SWITCHABLE PHYSICAL PROPERTIES AND ITS USE IN DIRECT EXPOSURE PRINTING PLATES

BACKGROUND OF THE INVENTION

1. Field of the Invention

The present invention relates to polymeric compositions, particularly thermally sensitive polymeric mixtures with metal compounds that are also polymerizably sensitive, more particularly with thermosensitive compositions and elements comprising at least one layer of the thermosensitive composition that is capable of being imaged by a laser for lithographic printing, the resulting printable image showing printing durability and not requiring a wash-off processing step.

2. Background of the Art

The art of lithographic printing is based on the immiscibility of oil and water, wherein the oily material or ink is preferentially retained by the image area of a printing plate and the water or fountain solution retained by the non-image area. Commonly the ink is transferred to an intermediate material called a blanket which in turn transfers the material the ink to the surface of the material upon which the image is to be reproduced. A widely used type of lithographic printing plate has a light (UV) sensitive coating applied to an aluminum base support. The coating may respond to the light by having the portion that is exposed becoming soluble and removed by a subsequent development process. Such a plate is said to be a positive working plate. Conversely, when the area that is exposed becomes hardened or polymerized the plate is referred to as a negative working plate. In both instances the image areas are ink-receptive or oleophilic. The background or hydrophilic area is typically aluminum which has been grained and anodized to provide a hydrophilic surface.

Direct digital imaging of offset printing plates (computer to plate CTP) is a technology that has assumed importance to the printing industry. In the use of this plate material, graphic information made by computer typesetting and desktop publishing is directly printed onto a plate by using a laser without an intermediate transfer material (film). The CTP process enables the rationalization and shortening of the plate making process as well as a reduction in material costs. Advances in solid state laser technology have made high powered diode lasers emitting energy at about 830 nm attractive light sources for carrying out this direct process. At least two printing technologies have been introduced which that can be imaged with laser. Plates are commercially sold by Kodak Polychrome Graphics which can be imaged in this way. These materials require a development step to produce the final image. Further printing technologies are described in EP-A-0 573 091 (Agfa) and several patents assigned to Presstek U.S. Pat. Nos. 5,353,705 and 5,379,698. This technology does not require a development step but instead relies on ablation to physically remove the imaging layer from the plate. Ablation requires high laser energy and power, resulting in low throughput and problems with debris after imaging.

Direct digital imaging without the use of a development step has been disclosed in U.S. Pat. No. 5,569,573 as a thermosensitive lithographic printing original plate comprising a substrate, a hydrophilic layer containing a hydrophilic binder polymer, and a microcapsuled oleophilic material which forms an image area by heating; the hydrophilic binder polymer having a three-dimensional cross-link and a functional group which chemically combines with the oleophilic material in the microcapsule when the microcapsule is decomposed, and the microcapsuled oleophilic material having a functional group which chemically combines with the hydrophilic binder polymer when the microcapsule is decomposed. The thermosensitive lithographic printing original plate is excellent in printing durability and storage property and provides prints having clear images because the plate does not collect scumming. Further, development is not required in the plate making process so that there are no problems with waste treatment and the like. Consequently, the original plate can be practically applied not only to a light printing such as a printing in offices but also to a rotary press of newspaper, form printing and the like.

Sulfamides have found utility in photosensitive media primarily as peripheral addenda, rather than as active ingredients in the photosensitive process. For example, U.S. Pat. No. 5,360,700 teaches the class of sulfamides as antifungal agents in silver halide solutions. This patent asserts that for the improved liquid preservability, it is preferable to add an antifungal agent to the stabilizing solution which is used instead of water washing and the stabilizing of the present invention. The antifungal agents which can be preferably used are salicylic acid, sorbic acid, dehydroacetic acid, hydroxybenzoic acid compounds, alkylphenol compounds, thiazole compounds, pyridine compounds, guanidine compounds, carbamate compounds, morpholine compounds, quaternary phosphonium compounds, ammonium compounds, urea compounds, isoxazole compounds, propanolamine compounds, sulfamide derivatives and amino acid compounds . . . The sulfamide derivatives include fluorinated sulfamide, 4-chloro-3,5-dinitrobenzenesulfamide, sulfanylamide, acetosulfamine, sulfapyridine, sulfaguanidine, sulfathiazole, sulfadiazine, sulfamerazine, sulfamethazine, sulfaisoxazole, homosulfamine, sulfisomidine, sulfaguanidine, sulfamethizole, sulfapyradine, phthalisosulfathiazole and succinylsulfathiazole.

Similarly, U.S. Pat. No. 4,765,973 teaches the use of anti-infectives, such as antibiotics, including penicillin, tetracycline, chlortetracycline bacitracin, nystatin, streptomycin, neomycin, polymyxin, gramicidin, oxytetracycline, chloramphenicol, and erythromycin; sulfonamides, including sulfacetamide, sulfamethizole, sulfamethazine, sulfadiazine, sulfamerazine, and sulfisoxazole, cefoxitin; anti-virals including idoxuridine; and other anti-infectives including nitrofurazone and sodium propionate in a polymer matrix to be provided for therapeutic treatment.

U.S. Pat. No. 4,020,150 teaches the oral administration of silver sulfadiazine or silver sulfamerazine and radioactive derivatives thereof in the treatment of malignant tumors, either by oral or subcutaneous administration.

U.S. Pat. No. 3,761,590, there is disclosed the fact that silver sulfadiazine and silver sulfadiazine-containing compositions of materials, particularly silver sulfadiazine dispersed in water-dispersible hydrophilic carrier or ointment are especially useful in burn therapy. Broadly, silver sulfadiazine when employed in the treatment of infections in man and animals exhibits anti-bacterial properties, antifungal properties and anti-protozoal properties, e.g., useful in the treatment of trichomonas vaginitis and also exhibits spermicidal activity.

U.S. Pat. Nos. 5,648,399; 5,639,795; and 5,438,076 teach liquid polymer compositions which may contain antimicrobial agents such as silver sulfadiazine, particularly for the treatment of gingivitis.

U.S. Pat. No. 5,622,168 teaches the use of a highly conductive hydrophilic gel comprising a uniform aqueous solution of a crosslinked water-soluble polymer, an amount of a water-soluble electrolyte effective to reduce the transverse electrical resistance of said aqueous mixture to an impedance at 60 Hz less than about 1,000 ohm, which hydrophilic gel also contains a humectant in an amount effective to retard the drying of the conductive hydrophilic gel when it is exposed to the atmosphere while being used. A physiological electrode adapted for providing electrical contact with a surface of a sentient creature and comprising a sheet of the conductive viscoelastic hydrophilic gel. Silver sulfadiazine is again added as an antimicrobial agent.

U.S. Pat. No. 4,376,764 also teaches the use of silver sulfadiazine as an antimicrobial agent in the use of silver ion gel compositions containing a polyoxybutylene-polyoxyethylene block copolymer that maintain their gel characteristics at temperatures below 20 degrees C. These gel compositions may be used to treat burn wounds and superficial ulcers.

In fact, applicants are unaware of the use of silver salts of sulfadiazine and sulfamerazine for purposes other than direct or indirect antimicrobial activity or other medical purposes.

U.S. Pat. No. 5,420,197 teaches a composition that includes a stable gel of neutralized chitosan and poly(N-vinyl lactam), the poly(N-vinyl lactam) having a K value of at least about 60 and mole equivalents of acid groups above about 1.4 from ring-opened pyrrolidones. The composition may also include a substrate and various additives incorporated with the gel. A method for making the gel includes mixing the chitosan and poly(N-vinyl lactam) in aqueous solution and curing. Products include wound packings, wound dressings, burn dressings, drug delivery dressings, cosmetic face masks and cosmetic wrap dressings. Active ingredients such as pharmaceuticals, including silver sulfadiazine may be included in the polymer composition.

Silver sulfadiazine is stable, insoluble in water, alcohol and ether and does not appear to stain or darken like other silver salts, such as silver nitrate. Silver sulfadiazine, when exposed to body fluids, such as when employed in burn therapy, appears to yield the combined properties of oligodynamic action of silver in addition to the advantages of an antibacterial agent. For example, when silver sulfadiazine is applied in an ointment to burn wounds, the silver sulfadiazine presents the advantages of silver and an anti-bacterial agent without the use of hypotonic solutions and without withdrawing body electrolytes. The silver sulfadiazine appears to react only gradually with the body fluids when used in burn therapy with the result that silver sulfadiazine when employed in burn therapy evidences a sustained active, effective concentration for as long as 24–72 hours after a single application. In contrast, a water-soluble, antibacterial agent, such as sodium sulfadiazine, would be used up rapidly and none would be left after a few days. Silver sulfadiazine when used in burn therapy, i.e., when applied to and/or exposed to body fluids, also appears to react with organic sulfahydryl groups or compounds in contact therewith.

Polymers and metals salts and particles have been combined for many various reasons, usually with the metal salts as fillers or compositing agents. For example, U.S. Pat. No. 5,952,093 describes a composite comprising a polymer matrix having, dispersed therein, delaminated or exfoliated particles derived from a multilayered inorganic material intercalated with an inorganic intercalant. Optionally, an organic intercalant can also be employed. If employed, the optionally employed organic intercalant can be calcined or at least partially removed from the multilayered inorganic material. The composite may comprise a polymer matrix having dispersed therein delaminated or exfoliated particles derived from a multilayered material which has been intercalated with an organic intercalant only which is subsequently calcined or otherwise at least partially removed from the layered, reinforcing material.

U.S. Pat. No. 5,948,599 describes a method of forming an image in a printing plate comprising the steps: (a) providing a radiation sensitive printing plate comprising a substrate coated with: (I) a coating comprising (1) a disperse water-insoluble heat-softenable phase A, and (2) a continuous binder phase B that is soluble or swellable in an aqueous medium; at least one of disperse phase A or continuous phase B having a reactive grouping, or precursor therefor, such that insolubilization of said coating occurs at elevated temperature and/or on exposure to actinic radiation, and (ii) a substance capable of strongly absorbing radiation and transferring the energy thus obtained as heat to the disperse phase so that at least partial coalescence of the coating occurs; (b) image-wise exposing the radiation sensitive plate to a beam of high intensity radiation, by directing the radiation at sequential areas of the coating and modulating the radiation so that the particles in the coating are selectively at least partially coalesced; (c) developing the image-wise exposed plate with aqueous medium to selectively remove the areas containing the non-coalesced particles and leave an image on the substrate resulting from the at least partially coalesced particles; and (d) heating the developed plate and/or subjecting it to actinic radiation to effect rapid reaction of said reactive grouping and insolubilization of said image.

U.S. Pat. No. 4,344,361 describes an automatic blanket cylinder cleaner having a cleaner fabric adapted to contact the blanket cylinder. A cleaning cloth supply roller provides cloth for the cloth take-up roll. Positioned between these rolls is a water solvent dispensing tube, a solvent dispensing tube and an inflatable and deflatable mechanical loosening means which is adapted to move the cleaning fabric into and out of contact with the blanket cylinder. An air dryer means dries the blanket cylinder after the cleaning of debris. An advancing means advances the cleaning cloth intermittently onto the take-up roller by a control means in contact with the take-up roll which provides for uniform cloth advance during the cleaning cycle. There is a control means providing automatic and manual control. This type of cleaning procedure may be used with the printing systems of the present invention. Similarly, Canadian Patent Application No. 2,175,410 describes pressure washing/cleaning systems and methods that may be used with the printing systems of the present invention.

U.S. Pat. No. 5,840,469 discloses a thermographic element comprising a support having coated thereon a thermographic emulsion comprising: (a) a light insensitive silver salt (e.g., silver salt of a carboxylic acid having 4 to 30 carbon atoms, silver benzoates, silver salts of compounds having mercapto or thione groups such as silver 3-mercapto-4-phenyl-1,2,4-triazolate, silver salts of thioglycolic acid and dicarboxylic acids, silver salts of benzotriazoles or imadazoles, and the like); a gallic acid reducing agent; and an infrared absorbing compound. Polymeric binders are also useful in forming the layer (as shown in column 5, lines 2–16). The system provides a change in optical density because of the thermally induced reduction of silver ion to form silver metal when the system is exposed to infrared radiation.

BRIEF DESCRIPTION OF THE INVENTION

The present invention relates to polymer materials which undergo a 2-level 3 dimensional crosslinking process. During this process, hydrophilic polymers are crosslinked at two levels, the first results in a low level of crosslinking which leads to a toughening of the layer preventing dissolution by the fountain solution but with the layer remaining hydrophilic. The second level of crosslinking is higher and is the result of exposure to a laser diode thermal imaging device. The crosslinking at this second level results in a loss of hydrophilicity and provides instead an oleophilic image capable of accepting and transferring oil based ink.

The polymer materials are particularly useful in lithographic printing systems where they may used in articles such as a printing plate comprising a substrate having coated thereon a layer that becomes that becomes less hydrophilic upon exposure to thermal energy (e.g., heat, particularly heat applied by a laser, other columnated light, or thermal printhead) that effects crosslinking (initial crosslinking or increased crosslinking) in the layer, the layer comprising a mixture of a crosslinked polymer and a thermally active crosslinking metal compound (e.g., a metal salt, metal ester or metal oxide).

The crosslinking reactions of the crosslinkable polymer appear to be interdependent with the crosslinking of the metal compound. The term interdependent means that crosslink bridges that are formed on the polymer during the thermal imaging treatment include residue of the metal compound or metal salt as part of the bridge, rather than the metal compound merely acting as a catalyst for the production of additional crosslinking bonds from the polymer or typically organic crosslinking agents added in combination with the active groups on the polymer. That is, the polymer first crosslinks with itself or with other specific crosslinking agents that react with organic groups in the monomer to form a first crosslinked polymeric chain or with other organic materials provided in the composition specifically for that crosslinking reaction. When the metal salts are thermally activated with the already crosslinked polymer, still statistically retaining some available polymerizable sites, the metal compounds further react with and possibly bridge specifically with other or the same groups or portions of the molecules of the already crosslinked polymer or residues or polymer that have not yet crosslinked within the polymer mass, with or without other ingredients (additional thermal crosslinking monomers or agents) specifically provided for reaction with those metal compounds or polymers. As examples to assist in the understanding of the term "interdependent," two polymer systems will be considered. A first system comprises a crosslinked acrylic polymer, having available carboxylic acid groups remaining on the polymer. When a metal salt or metal compound having an at least divalent metal atom is heated in the presence of the crosslinked polymer with available acid groups, the metal will form additional crosslinking within the polymer structure, with the metal depending upon available units in the primary crosslinked polymer to form additional crosslinking bonds. In a second virtual system, a first crosslinked network can be formed by an epoxy resin with linking groups having been formed by conventional compounds having a multiplicity of groups that are reactive in the epoxy polymerization process. A second polymer, either itself crosslinked with additional groups available or a linear polymer containing groups that are reactive with the thermally activatable metal compounds or thermally activated metal salts of the present invention, is also present in the composition. This could be an acrylic material, a carboxylic acid substituted polyurethane, a polyester having pendant carboxylic acid groups, or the like. When the thermally activated metal salts react to crosslink this second polymer, the crosslinking bonds do not form between the primary epoxy xrosslinked polymer, but forms an independent network of crosslinked polymer. Such systems might also be referred to in the art as an interpenetrating network of distinct polymer chains, although the polymers known to applicants have been manufactured by distinctly different polymerization and crosslinking mechanisms. These are therefore independent networks of polymers, without the crosslinking effected by the metal salts directly contributing to the crosslink bonds in the already crosslinked polymer.

The residues of the metal compounds, such as metal cations, may also react with available groups on the polymer, as when they form salts with acid groups, but this reaction is not necessarily effective with regard to causing or adding three-dimensional structure to the polymer network or the compositional network. In this manner, the polymer network formed may have crosslink bonds consistent with bonding exclusively by native polymeric material as well as crosslink bonds formed by bridging of the native polymeric material by moieties provided by the metal compounds. It is preferable that the crosslinkable polymer comprises an ethylenically unsaturated polymer, and more preferable that the polyethylenically unsaturated polymer comprises a (meth) acrylic polymer. It is also preferred that the metal compound comprise a metal salt, such as comprising a metal salt of a sulfamide, such as where the metal salt is selected from the class consisting of metal salts of sulfamide, sulfanylamide, acetosulfamine, sulfapyridine, sulfaguanidine, sulfamethoxazole, sulfathiazole, sulfadiazine, sulfamerazine, sulfamethazine, sulfaisoxazole, homosulfamine, sulfisomidine, sulfaguanidine, sulfamethizole, sulfapyradine, phthalisosulfathiazole and succinylsulfathiazole. The metal salts may also comprise any other metal organic salt (particularly light-insensitive slats such as light insensitive silver salts) such as metal salts of saccharides, thiocarbamates, benzthiozoles, benzamidazoles (silver saccharide, silver diethyldithiocarbamate, silver benzthiazole, silver benzamidazole, etc., and other salts and complexed salts (e.g., U.S. Pat. No. 4,260,677, which is incorporated herein by reference for its disclosure on useful complexes of metal compounds) known to be thermally degradable as in photothermographic imaging systems.

The materials can be applied to the substrate by known coating techniques such as spraying or dipping. An important characteristic of the dried layer is its adhesion to the substrate. This allows the use of materials other than anodized aluminum for the substrate of the plate.

All of the silver salts and the metal salts of the sulfamides can be readily synthesized by a reaction of sodium sulfamide with a silver salt, such as silver nitrate. A general example of this is the synthesis of silver sulfadiazine, which was prepared by reacting equal-molar concentrations of sulfadiazine and silver nitrate. The insoluble reactant was washed until the supernate was silver-free after adding sodium chloride (0.9%) in volumes ten times that of the silver sulfadiazine supernatant. The silver sulfadiazine was washed with acetone and then separate washings of petroleum ether. The precipitate was then placed in a desiccator until all ether had been removed and the precipitate was a dry white, fluffy material.

The compositions may be applied from any solvent that supports the system. Preferred solvents include methyl amyl ketone, xylene, PM acetate, toluene, "Cellosolve" acetate, ethanol, isopropyl alcohol, methoxy propanol, xylene, ethoxy ethyl acetate, ethyl benzene, diethyl "Cellosolve", "Cellosolve" acetate, PM acetate, and mixtures thereof or mixtures with water. The more preferred hydrocarbon solvents include ethanol, isopropyl alcohol, and methoxy propanol, and mixtures thereof. Water-borne coating formulations may be prepared by combining with a suitable coalescent ingredient or coalescent mixture, a suitable polymeric thickener, a suitable leveling aid, a suitable plasticizer, a suitable pigment, and other suitable additives. As noted above, a suitable hydrocarbon solvent or hydrocarbon solvent mixture may be combined with water to produce a particular volatile liquid carrier. In certain other embodiments, however, a particular suitable volatile liquid carrier might not include water.

The thermoset component or crosslinking polymeric component of the invention may comprise any polymeric that is a crosslinked polymer after it is coated onto a substrate (it of course does not have to be crosslinked before its is coated onto the surface, as that becomes more difficult, as many crosslinked materials are not soluble. The crosslinked polymer may be more greatly crosslinked (e.g., its crosslink density, the number or crosslinking bonds per molecular weight, will increase) after its is irradiated according to the procedures of exposure in the present invention. Thermoset resins differ from thermoplastic polymers in that they become substantially infusible or insoluble irreversibly since they are cured (cross-linked) as opposed to the thermoplastics which are typically not cross-linkable and soften when exposed to heat and are capable of returning to original conditions when cooled. Representative examples of thermoset polymers which may be useful in the practice of the present invention include thermoset phenolic resins such as thermosettable resins containing sufficient reactive groups that can allow three-dimensional polymerization between or among such units as alkoxy-silane units, aryloxy-silane units, ethylenically unsaturated units, polyols, polyacids, poly(meth)acrylate units, isocyanate units, resorcinol, p-tertiary-octylphenol, cresol, alkylated phenolic novalac, phenolic polyvinyl butyral, and phenolic cresol and an aldehyde such as formaldehyde, acetaldehyde or furfural; thermoset polyimide resins such as those curable resins based on pyromellitic dianhydride, 3,3',4,4'-benzophenonecarboxylic dianhydride and meta-phenylenediamine; thermoset epoxides or epoxy resins such as the resins containing the reaction product bisphenol A or derivatives thereof, e.g., the diglycidyl ether of bisphenol A, or a polyol such as glycerol with epichlorohydrin and a cross-linking or curing agent such as a polyfunctional amine, e.g., polyalkylenepolyamine; thermoset polyester resins such as the reaction products of an unsaturated dicarboxylic acid such as maleic or fumaric acid (which may be used in combination with a saturated acid such as phthalic or adipic acid) with a dihydric alcohol such as ethylene, propylene, diethylene and dipropylene glycol which cure upon using an ethylenic unsaturated curing agent such as styrene or diallyl phthalate, including thermosettable allyl resins including resins derived from diallyl phthalates, e.g., diallyl orthophthalate, diallyl isophthalate, diallyl fumarates and diallyl maleates; thermoset polyurethanes including those derived from the reaction of a diisocyanate, e.g., toluene diisocyanate, methylene diphenyl diisocyanate, or isophorone diisocyanate, or a polymeric isocyanate with a polyhydric alcohol such as polypropylene glycol and, if required, an additional cross-linking agent such as water; thermoset urea resins; melamine resins, furan resins, and vinyl ester resins including epoxy (meth)acrylates. Where the term "(meth)acrylic" or "(meth) acrylate" is used, that term is inclusive of both acrylic and methacrylics.

The polymer may include additional additives, such as adhesion promoting additives such as acrylonitrile, compounds with phosphonic acid groups on it, benzotriazoles. Representative examples of three-dimensionally cross-linked hydrophilic binder polymer are as follows. For the hydrophilic binder polymer, a hydrophilic homopolymer or a hydrophilic copolymer is synthesized using one or more hydrophilic monomers having a hydrophilic group selected from a carboxyl group or its salt, a sulfonic group or its salt, a phosphoric group or its salt, an amino group or its salt, a hydroxyl group, an amide group and an ether group such as a (meth)acrylic acid or its alkali metal salt and amine salt, an itaconic acid or its alkali metal salt and amine salt, 2-hydroxyethyl(meth)acrylate, (meth)acrylamide, N-monomethylol(meth)acrylamide, N-dimethylol(meth) acrylamide, allyl amine or its hydrohalogenic acid salt, 3-vinylpropionic acid or its alkali metal salt and amine salt, vinyl sulfonic acid or its alkali metal salt and amine salt, 2-sulfoethyl(meth)acrylate, polyoxyethylene glycol mono (meth)acrylate, 2-acrylamide-2-methylpropanesulfonic acid, and, acid phosphoxy polyoxyethylene glycol mono (meth)acrylate.

For hydrophilic binder polymers having a functional group such as a carboxyl group or its salt, an amino group or its salt, a hydroxyl group, and an epoxy group introduce an additional polymerizable ethylenically unsaturated group such as a vinyl group, an allyl group and a (meth)acryloyl group or a ring formation group such as a cinnamoyl group, a cinnamylidene group, a cyanocinnamylidene group and p-phenylenediacrylate group. The obtained polymers containing these unsaturated groups are mixed with monofunctional and polyfunctional monomers copolymerizable with the unsaturated groups, the below-mentioned polymerization initiator, and the below-mentioned other components, if necessary. Then, it is dissolved in a proper solvent to prepare a dope. The dope is applied to a substrate, and cross-linked after or during drying to obtain a three-dimensionally cross-linked binder polymer.

For hydrophilic binder polymers having a functional group containing active hydrogen such as a hydroxyl group, an amino group and a carboxyl group are mixed with an isocyanate compound or a blocked polyisocyanate, and the below-mentioned other components. Then, the obtained mixture is dissolved in a solvent which does not contain the active hydrogen to prepare a dope. The resulting dope is applied to a substrate, and three-dimensionally cross-linked after or during drying to obtain a cross-linked binder polymer.

Furthermore, a monomer having a glycidyl group such as glycidyl (meth)acrylate, a carboxylic group such as (meth) acrylic acid, and/or an amino group can be used as a copolymerizable component of the hydrophilic binder polymer. The hydrophilic binder polymers having a glycidyl group are three-dimensionally cross-linked by a ring-opening reaction, in which the polymer reacts with, as a cross-linking agent, .alpha., omega.-alkane or alkenedicarboxylic acid such as 1,2-ethanedicarboxylic acid, and adipic acid, a polycarboxylic acid such as 1,2,3-propanetricarboxylic acid, and trimellitic acid, a polyamine compound such as 1,2-ethanediamine, diethylenediamine, diethylenetriamine, and alpha., .omega.-bis-(3-aminopropyl)-polyethylene glycol ether, an oligoalkylene or polyalkylene glycol such as ethylene glycol, propylene glycol, diethylene glycol, and tetraethylene glycol, and a polyhydroxy compound such as trimethylolpropane, glycerin, pentaerythritol, or sorbitol. The hydrophilic binder polymers having a carboxylic group and an amino group are three-dimensionally cross-linked by an epoxy ring-opening reaction, in which the binder polymer reacts with a polyepoxy compound, as a cross-linker, such as ethylene or propylene glycol diglycidyl ether, polyethylene or polypropylene glycol diglycidyl ether, neopentyl glycol diglycidyl ether, 1,6-hexanediol diglycidyl ether, or trimethylolpropane triglycidyl ether.

When a polysaccharide such as cellulose derivatives, a polyvinyl alcohol or its partially saponified derivatives, a glycidol homopolymer or copolymer, or their derivatives are used as a hydrophilic binder polymer, the above-mentioned cross-linkable functional groups are introduced into the polymer through the hydroxyl groups which the above compounds possess. As a result, a three-dimensional cross-link is accomplished according to the above method.

Furthermore, a hydrophilic polyurethane precursor is produced by reacting a polyol having a hydroxyl group such as polyoxyethylene glycol at the termini of the polymer or a polyamine having an amino group at the termimi (ends) of the polymer with polyisocyanate such as 2,4-tolylene diisocyanate, 2,6-tolylene diisocyanate, 1,6-hexamethylene diisocyanate, or isophorone diisocyanate. Then, an additional polymerizable ethylenically unsaturated group or a ring forming group is introduced into the hydrophilic polyurethane precursor to obtain a hydrophilic binder polymer. The hydrophilic binder polymer can be three-dimensionally cross-linked by the above-mentioned method. When the hydrophilic polyurethane precursor has an isocyanate group at its termimi, the precursor is reacted with a compound containing an active hydrogen such as glycerol mono(meth) acrylate, 2-hydroxyethyl(meth)acrylate, 2-hydroxypropyl (meth)acrylate, N-monomethylol(meth)acrylamide, N-dimethylol(meth)acrylamide, (meth)acrylic acid, cinnamic acid, or cinnamic alcohol.

When the precursor has a hydroxyl group or an amino group at its termini, it is reacted with (meth)acrylic acid, glycidyl (meth)acrylate and/or 2-isocyanatoethyl (meth) acrylate. When polymers comprising a polybasic acid and a polyol, or a polybasic acid and a polyamine are used as a hydrophilic binder polymer, they are applied on a substrate. Then, they are heated for a three-dimensional cross-linking. When casein, glue, and gelatin are used as a hydrophilic binder polymer, their water-soluble colloidal compounds are heated for three-dimensional cross-linking to obtain a net structure.

Further, a hydrophilic binder polymer can be produced by reacting a hydrophilic polymer having a hydroxyl group or an amino group with a polybasic acid anhydride containing two or more acid anhydride groups in one molecule to obtain a three-dimensionally cross-linked hydrophilic binder polymer. The hydrophilic polymer includes a homopolymer or copolymer comprising a hydroxyl group containing monomers such as 2-hydroxyethyl(meth)acrylate and vinyl alcohol, and allyl amine; partially saponified polyvinyl alcohol; a polysaccharide such as cellulose derivatives; and glycidol homopolymer or copolymer. Representative examples of the polybasic acid anhydride used are ethylene glycol bis anhydro trimellitate, glycerol tris-anhydro trimellitate, 1 ,3,3a,4,5,9b-hexahydro-5-(tetrahydro-2,5-dioxo-3-furanyl)naphtho[1,2-C]--furanyl-1,3-dione, 3,3',4,4'-diphenylsulfone tetracarboxylic dianhydride, 1,2,3,4-butanetetracarboxylic dianhydride and the like.

When the hydrophilic binder polymer comprises polyurethane having isocyanate groups at its termini and a compound containing active hydrogen such as polyamine and polyol, these compounds and other components listed below are dissolved or dispersed in a solvent. They are applied to the substrate, and the solvent is removed. Then, the plate is cured at a temperature at which a microcapsule is not broken to obtain three dimensional cross-linking. In this case, hydrophilic property is given by introducing a hydrophilic functional group into segments of either polyurethane or a compound containing active hydrogen or the segments both of them, or into their side chain. The segments and functional groups possessing hydrophilic property can be selected from the above list.

The polyisocyanate compounds used in the present invention include 2,4-tolylene diisocyanate, 2,6-tolylene diisocyanate, 4,4'-diphenylmethane diisocyanate, 1,5-naphthalene diisocyanate, tolidine diisocyanate, 1,6-hexamethylene diisocyanate, isophorone diisocyanate, xylene diisocyanate, lysine diisocyanate, triphenyhnethane triisocyanate, bicycloheptane triisocyanate.

In some cases, it is preferred to block (mask) the isocyanate groups by the conventional method for the purpose of preventing the isocyanate groups from changing at handling before and after the coating process. For example, the isocyanate groups can be blocked with acid sodium sulfite, aromatic secondary amine, tertiary alcohol, amide, phenol, lactam, heterocyclic compounds, ketoxime and the like according to the methods disclosed in Lecture for Plastic Material vol. 2—Polyurethane Resin—(IWATA, Keiji, Nikkan Kogyo Shimbun, 1974) pp. 51–52 and Polyurethane Resin Handbook (IWATA, Keiji, Nikkan Kogyo Shimbun, 1987) pp. 98, 419, 423 and 499. Preferably, the isocyanate groups are blocked with a compound having a low recovering temperature of isocyanate and hydrophilic property such as acid sodium sulfite.

An additional polymerizable unsaturated group may be added to either non-blocked or blocked polyisocyanates as mentioned above for the purpose of strengthening the cross-link or using it for a reaction with an oleophilic material.

The degree of cross-link, i.e., an average molecular weight between cross-links, of the hydrophilic binder polymer of the present invention, which differs depending on the type of segments used and the type and amount of associative functional groups, is determined according to the required printing durability. Generally, the average molecular weight between cross-links is fixed between 500 and 50,000, which may be measured either before the second crosslinking step in the procedure of after the second crosslinking step in the procedures practiced in the present invention. When it is smaller than 500, the printing plate is likely to be brittle and printing durability is deteriorated, although the plate is still functional. When it is greater than 50,000, printing durability may be deteriorated due to the swelling of dampening water, but again, the plate is still functional. In view of the balance of printing durability and hydrophilic property, the average molecular weight between cross-links is preferably 800 to 30,000, more preferably 1,000 to 10,000 at the conclusion of crosslinking steps in the preparation of the actual imaged and processed plate of the present invention.

Of these, the hydrophilic binder polymers comprising hydrophilic homopolymer or copolymer synthesized using one or more hydrophilic monomers having a hydrophilic group selected from a carboxyl group or its salt, a sulfonic group or its salt, a phosphoric group or its salt, an amino group or its salt, a hydroxyl group, an amide group and an ether group such as a (meth)acrylic acid or its alkali metal salt and amine salt, an itaconic acid or its alkali metal salt and amine salt, 2-hydroxyethyl(meth)acrylate, (meth) acrylamide, N-monomethylol(meth)acrylamide, N-dimethylol(meth)acrylamide, allylamine or its hydrohalogenic acid salt, 3-vinyl propionic acid or its alkali metal salt and amine salt, vinyl sulfonic acid or its alkali metal salt and amine salt, 2-sulfoethylene(meth)acrylate, polyoxyethylene glycol mono(meth)acrylate, 2-acrylamide-2-methylpropane sulfonic acid and acid phosphoxy polyoxyethylene glycol mono(meth)acrylate: or polyoxymethylene glycol or polyoxyethylene glycol which are three-dimensionally cross-linked according to the above mentioned methods are preferred.

The hydrophilic binder polymer of the present invention may be used with the following monofunctional monomer or polyfunctional monomer. Representative examples include, those disclosed in Handbook for Cross-Linking Agents, edited by YAMASHITA, Shinzo and KANEKO, Tosuke, Taiseisha, 1981; Hardening System with Ultraviolet, KATO, Kiyoshi, Comprehensive Technology Center, 1989; UV.cn-dot.EB Hardening Handbook (Material), edited by KATO, Kiyoshi, Kobunshi Kankokai, 1985; pp. 102–145 of New Practical Technology for Photosensitive Resin, supervised by AKAMATSU, Kiyoshi, CMC, 1987 and the like, N,N'-methylenebisacrylamide, (meth)acryloylmorpholine, vinyl pyridine, N-methyl(meth)acrylamide, N,N-dimethyl(meth) acrylamide, N,N-dimethylaminopropyl(meth)acrylamide, N,N-dimethylaminoethyl(meth)acrylate, N,N-diethylaminoethyl(meth)acrylate, N,N-dimethylaminoneopentyl(meth)acrylate, N-vinyl-2-pyrrolidone, diacetone acrylamide, N-methylol(meth) acrylamide, parastyrene sulfonic acid or its salt, methoxytriethylene glycol (meth)acrylate, methoxytetraethylene glycol (meth)acrylate, methoxypolyethylene glycol (meth)acrylate (PEG number-average molecular weight: 400), methoxypolyethylene glycol (meth)acrylate (PEG number-average molecular weight: 1,000), butoxyethyl (meth)acrylate, phenoxyethyl(meth)acrylate, phenoxydiethylene glycol (meth)acrylate, phenoxypolyethylene glycol (meth)acrylate, nonylphenoxyethyl(meth)acrylate, dimethylol tricyclodecane di(meth)acrylate, polyethylene glycol di(meth)acrylate (PEG number-average molecular weight: 400), polyethylene glycol di(meth)acrylate (PEG number-average molecular weight: 600), polyethylene glycol di(meth)acrylate (PEG number-average molecular weight: 1,000), polypropylene glycol di(meth)acrylate (PEG number-average molecular weight: 400), 2,2-bis[4-(methacryloyloxyethoxy)phenyl]propane, 2,2-bis[4-(methacryloyl-oxy-diethoxy)phenyl]propane, 2,2-bis[4-methacyloyl-oxy-polyethoxy)phenyl]propane or its acrylate, .beta.-(meth)acryloyl-oxyethyl hydrogen phthalate, .beta.-(meth)acryloyl-oxyethyl hydrogen succinate, polyethylene or polypropylene glycol mono(meth)acrylate, 3-chloro-2-hydroxypropyl(meth)acrylate, 1,3-butylene glycol di(meth)acrylate, 1,6-hexanediol di(meth)acrylate, neopentyl glycol di(meth)acrylate, trimethylolpropane tri(meth) acrylate, tetramethylolmethane tri(meth)acrylate, tetramethylolmethane tetra(meth)acrylate, isobornyl(meth) acrylate, lauryl(meth)acrylate, tridecyl(meth)acrylate, stearyl(meth)acrylate, isodecyl(meth)acrylate, cyclohexyl (meth)acrylate, tetrafurfuryl(meth)acrylate, benzyl(meth) acrylate, mono(2-(meth)acryloyl-oxyethyl)acid phosphate, glycerin mono(meth)acrylate or glycerin di(meth)acrylate, tris(2-(meth)acryloyl-oxyethyl)isocyanurate, N-phenylmaleimide, N-(meth)acryloxy succinate imide, N-vinylcarbazole, divinylethylene urea, divinylpropylene urea and the like.

To effect a desired polymerization reaction, it may at certain times be necessary to include a suitable free-radical initiator or mixture of initiators, in our novel composition. Suitable initiators for this purpose include peracetic acid; hydrogen peroxide; di-tertiary-butyl peroxide ("DTBP"); as well as various percarbonates, persulfates, perphosphates, perborates, and azo compounds. Suitable azo-type free-radical initiators for purposes of this disclosure include 2,2'-azobisisobutyronitrile ("AIBN"), azobis(alpha, gamma-dimethylcapronitrile), azobisisobutyl nitrile, azobis(alpha-ethylbutyl nitrile), and azobisdimethyl valeronitrile. (See, for example, pages 194–197 and 215–223 of a well-known textbook entitled Principles of Polymerization, second edition, by George Odian, published in 1981 by John Wiley & Sons, Inc.). Among the well-known water-soluble initiators used in emulsion polymerization reactions and which may be mentioned are acetyl peroxide and hydrogen peroxide; hydroperoxides such as tertiary-butyl hydroperoxide; and sodium, potassium, ammonium and barium persulfate.

Where the thermal address is to be performed by lasers, it is desirable to have thermal converters present in the composition that absorb the radiation in the region of luminance wavelength of a laser and convert it to thermal energy. Such substances include dyes, pigments and coloring materials, which are disclosed in JOEM Handbook 2 Absorption Spectra of Dyes for Diode Lasers, MATSUOKA, Ken, Bunshin Shuppan, 1990 and Chapter 2, 2.3 of Development and Market Trend of Functional Coloring Materials in 1990's, CMC Editorial Department, CMC, 1990, such as a polymethine type coloring material (cyanine coloring material), a phthalocyanine type coloring material, a dithiol metallic complex salt type coloring material, naphthoquinone, an anthraquinone type coloring material, a triphenylmethane type coloring material, aluminum, a di-iminonium type coloring material, an azo type dispersion dye, an indoaniline metallic complex coloring material, and an intermolecular CT coloring material. The representative examples include N-[4-[5-(4-dimethylamino-2-methylphenyl)-2,4-pentadienylidene]-3-methyl-2,5-cyclohexadiene-1 -ylidene]-N,N-dimethylammonium acetate, N-[4-[5-(4-dimethylaminophenyl)-3-phenyl-2-pentene-4-in-1-ylidene]-2,5-cyclohexadiene-1-ylidene]-N,N-dimethylammonium perchlorate, N,N-bis(4-dibutylaminophenyl)-N-[4-[N,N-bis(4-dibutylaminophenyl)amino]phenyl]-aminium hexafluoroantimonate, 5-amino-2,3-dicyano-8-(4-ethoxyphenylamino)-1,4-naphthoquinone, N'-cyano-N-(4-diethylamino-2-methylphenyl)-1,4-naphthoquinonediimine, 4,11-diamino-2-(3-methoxybutyl)-1-oxo-3-thioxopyrrolo[3,4-b]anthracene-5,10-dione, 5,16-(5H,16H)-diaza-2-butylamino-10,11-dithiadinaphtho[2,3-a:2'3'-c]-naphthalene-1,4-dione, bis(dichlorobenzene-1,2-dithiol) nickel(2:1)tetrabutylammonium, tetrachlorophthalocyanin aluminum chloride, and polyvinylcarbazol-2,3-dicyano-5-nitro-1,4-naphthoquinone complex. Carbon black, other black body absorbers, and other infrared absorbing materials, dyes or pigments may also be used as the thermal converter, particularly with higher levels of infrared absorption/conversion at 810–880 nm, and particularly between 810–850 nm.

Examples of Silver Sulfadiazine and Derivatives and Iron and Copper Sulfadiazines Preparation Metal sulfa derivatives were all prepared by making the sodium salt of the ligand with sodium hydroxide and heating till dissolved. Adding this solution warm to a warm aqueous solution of the metal nitrate precipitating the metal sulfa derivative. The precipitate was filtered and dried in 60 degree oven. The materials used in the patent examples were obtained from the following sources:

The metal sulfa ligands, zinc nitrate hexahydrate and the silver sulfadiazine were purchase from Spectrum Chemical (Gardena, California). Behenic acid was purchased from Witco as Hystreen 9022. Zinc oxide (Kadox 911) was obtained from Zinc corporation of America. Polyvinyl butyral was purchased from Solutia as Butvar B72. Poly (styrene-alt-maleic acid) copolymer was obtained as the sodium salt and converted to the acid by reaction with hydrochloric acid and precipitation. Polyacrylic acid, MW 450,000, poly(ethylene/maleic acid) (1:1) MW 100000, poly (butadiene/maleic acid) 1:1 (molar) MW 10000–15000 were obtained from Polyscience Inc of Pennsylvania, U.S.A. ADS830A, ADS 830WS, infra-red absorbing dyes, were purchased from American Dye Source Inc. of Montreal, Canada. An infra-red absorbing dye, Sands 3984, was obtained from Sands chemical. Chitosan, glutaric dialdehyde, glyoxal, dodecyl sodium sulfate, silver toluenesulfonate, poly (methyl vinyl ether-alt-maleic acid) MW 216000 were obtained from Aldrich, Milwaukee, U.S.A. Tyzor TE, Tyzor AA 75 and 135 are products of DuPont Inc, Wilmington, U.S.A.. Other materials were obtained from VWR Canlab of Mississauga, Canada. The molecular weight of the various polymers that were obtained were measured by the supplier using GPC against known standards.

1. Silver Sulfamerazine prepared using 26.43 g sulfamerazine, 300 ml of water, 4.00 grams of NaOH warming to 70 degree C. until dissolved. 16.99 grams of silver nitrate in 300 grams of water with 1 drop of 10% nitric acid and warming to 70 degree C. The sulfamerazine solution was added to the silver nitrate solution with stirring. Silver sulfamerazine precipitated as a fine white powder. This was filtered and washed three times with water and dried overnight at 60 deg to give an off-white powder.
2. Silver Sulfamethazine was prepared using 27.83 grams of sulfamethazine following procedure 1 to give a fine white powder showing some crystallinity.
3. Silver sulfamethoxazole was prepared following procedure 1 and using 25.33 sulfamethoxazole. A fine white powder showing no crystallinity
4. Copper Sulfadiazine was prepared following procedure 1 and using 52.86 grams of sulfadiazine and 23.27 grams of cupric nitrate. The copper sulfadiazine was dark purplish precipitate.
5. Iron Sulfadiazine was prepared using procedure one and using 18.8 g of sulfadiazine and 10.1 grams of ferric nitrate. The iron sulfadiazine, pinkish red powder had some white crystals present(some unreacted sulfadiazine).
6. Silver Behenate was prepared using procedure one and using 10 g of behenic acid and 4.8 g of silver nitrate to give a white powder.
7. Zinc sulfadiazine was prepared by using 90.1 grams of sodium sulfadiazine dissolved in water and 49.2 g zinc nitrate hexahydrate in water. When combined the white zinc sulfadiazine precipitated out. Filtered, rinsed with water and dried to yield a fine white powder.

Plate Formulations

The general procedure used was to make a dispersion of each metal sulfa derivative by taking 15 grams of each, 7.5 grams of ZnO, Kadox 911, and 10.5 grams of 5% polyvinyl butyral (Solutia Butvar B72,) solution in ethanol and 117 grams of ethanol. This was ball milled with glass marble for 18–24 hours to form a stable dispersion. Each dispersion was formulating into a part A of a coating by mixing 16.1 grams of dispersion with 0.8 grams of a 5% acetic acid/water, 5.3 grams of water and 15.7 grams of isopropyl alcohol. A part B resin solution was mixed using 22.6 grams of 7.5% ethanol solution of polyacrylic acid, 450,000 MW from Polyscience For example, the following is a guide to proper description of Molecular Weight basis (the molecular weight in this and other examples is a weight average molecular weight, usually provided by the manufacturer).

[In these various examples, the molecular weights of the polymeric ingredients, prepared as set forth in the below-described examples, were determined via gel-permeation chromatography ("GPC") analytical techniques, using tetrahydrofuran as eluent and poly(styrene) standards. The poly(styrene) standards utilized, presently commercially available from the Dow Chemical Company of Midland, Michigan, are more particularly characterized as having number-average molecular weight ("Mn") values of 2,250,000; 1,030,000; 570,000; 156,000; 66,000; 28,500; 9,200; 3,250; and 1,250]

These were evaluated by running on a Ryobi single color printing press. All demonstrated good hydrophobic/hydrophilic balance with the imaged area taking the ink. All of the plates rolled up within 30 prints and were able print out to 3,000 except the iron sulfadiazine that showed marginal printing performance.

The compositions of the present invention are conveniently used in direct-to-press systems such as those described in detail in U.S. Pat. No. 5,713,287 (Gelbart). The plates can then even be cleaned on press by various available commercial methods, for example cloth-type cleaners, spray wash cleaners, roller cleaners, dip cleaners, and the like.

EXAMPLE 1

A dispersion was made by preparing a mixture containing 15 grams copper sulfadiazine, 7.5 grams of ZnO, and 10.5 grams of 5% polyvinyl butyral solution in ethanol and 117 grams of ethanol. The mixture was ball milled with glass marbles for 18–24 hours and then passed through a microfluidiser to form a stable dispersion. The dispersion was formulated into a part A of a two part coating system by mixing 16.1 grams of the dispersion with 0.8 grams of a 5% acetic acid water, 5.3 grams of water and 15.7 grams of isopropyl alcohol. The part B resin solution was made using 22.6 grams of 7.5% ethanol solution of polyacrylic acid, 450,000 MW, 18.3 grams of 2% ethanol solution of infra red absorbing dye 830A, and 112 grams of ethanol. The materials were mixed using an in-line mixer just prior to being sprayed onto the back of an aluminum printing plate to give a dry coating weight of 2.5 g square meter. The material was dried using warmed air and then imaged using a power of 10 Watts and an energy of 550 mJ/cm$^2$ on a Creo Products Inc. Trendsetter laser plate setting machine. The imaged sample was mounted onto a press, dampened and then used to print 500 good impressions. The plate was taken off the press and the ink removed using a plate cleaner. The coating was then removed using a cloth impregnated with 5% sodium carbonate. The plate was rinsed with water and dried. The substrate was re-coated with a further amount of the 2 component mixture and dried. A new image was created onto the coating using the infra red imaging device and the plate used for printing. 1000 good impressions were obtained. There was no evidence of the previous image on the print.

EXAMPLE 2

A dispersion consisting of 7.5% Silver behenate and 0.2% Polyvinyl butyral in ethanol/water at a weight ratio of 70/30 was prepared. The mixture was ball milled overnight. The following formulation is made up: 5 g 1% chitosan, 5 g 0.3% ADS 830WS, 0.5 g 3% ADS 830A, 1.6 g Silver behenate dispersion, 0.5 g 0.1 M glutaric dialdehyde, 0.25 g 1% dodecyl sodium sulfate. The components are mixed in a glass bottle using a magnetic stirrer and are coated onto grained, anodised aluminum plates. The plates were dried in air for 10 minutes to give a dry coat weight of 3 g/m2 and then subjected to image-wise IR-laser exposure using a Creo Products Inc. Trendsetter using 400 mJ/cm$^2$ at 9 watts. The plate performance was evaluated by printing using a Ryobi press with coated paper and a commercial cold-set ink. The plate permitted full ink density to be achieved in less than 50 sheets. 12,000 good impressions were obtained from the plate.

EXAMPLE 3

A plate was produced by coating the following formulation on to grained, anodised aluminum as follows: 5 g 1% chitosan, 5 g 0.3% ADS 830WS, 0.5 g 3% ADS 830A, 2.5 g Silver sulfadiazine dispersion. The Silver sulfadiazine dispersion consists of 8.5% Silver sulfadiazine and 0.2% polyvinyl butyral in ethanol/water at a weight ratio of 70/30. The dispersion was milled before use. 0.5 g 0.1M glutaric dialdehyde, 0.25 g 1% dodecyl sodium sulfate. After drying in air, the plate was imaged using IR-laser exposure using 500 mJ/cm$^2$ at 16 watts. The plate was dampened with fountain solution for 30 seconds before the ink is applied to the plate. 12,000 impressions were printed with little deterioration of printing quality. Start-up performance was good and no scumming was evident during the print run.

EXAMPLE 4

A formulation was prepared by a similar method to Example 3 except that 0.5 g of 0.1M glyoxal was used in place of glutaric dialdehyde. The formula was coated onto grained, anodised aluminum plates and dried in air. The coated plates were subjected to IR-laser exposure with an energy of 1500 mJ/cm$^2$ at 16 watts. The plate was mounted on a Ryobi press. The plate was run for 12,000 impressions displaying good printing performance.

EXAMPLE 5

A formulation was prepared by a similar method to Example 3 except that an equal weight of silver sulfamethoxazole was used in place of the silver sulfadiazine. The formula was coated onto grained, anodised aluminum plates and dried in air. The coated plate was subjected to IR-laser exposure with an energy of 500 mJ/cm$^2$ at 16 watts. The plate was mounted on a Ryobi press and printed for 5,000 impressions displaying good printing performance.

EXAMPLE 6

A dispersion was made from silver sulfamethoxazole 10%, ZnO 5.0% and polyvinyl butyral 0.35% and ethanol 84.65%. The dispersion was ball milled and then microfluidized to obtain a particle size of less than 2 microns. The following formula was made up using 4 g silver sulfamethoxazole dispersion, 1 g 7.5% poly(acrylic acid), 1 g 7.5% ethylene-alt-maleic acid copolymer, 0.5 g 3% ADS 830A and 1 g 0.03 M Tyzor™ AA-135 (The Tyzor™ series of compounds are titanium salts, usually further identified by the alphanumerics following the Brand Name, such as "AA" representing titanium acetyl acetonoate). The components were mixed by magnetic stirrer, and then were manually coated onto grained, anodised aluminum plates. After drying in air for 10 minutes, the coated plates were subjected to IR-laser exposure using the Creo Products Inc. Trendsetter Platesetter. The imaging energy was 800 mJ/cm$^2$ at 16 watts. The plate was mounted on the Ryobi press and dampened for 30 seconds. 10,000 impressions of good quality print were obtained.

EXAMPLE 7

A dispersion was made up in the same way as in the previous Example 6 except that silver sulfamerazine was used in place of silver sulfamethoxazole. The silver sulfamerazine dispersion 4 g was then mixed with 1 g 7.5% PAA[polyacrylic acid], 1 g 7.5% ethylene-alt-methacrylic acid copolymer, 0.5 g 3% ADS 830A and 1 g 0.03 M Tyzor AA-135. The coating was applied using a doctor box onto grained anodised aluminum plates and then dried in air to give a coating weight of about 2.5 g/m$^2$. The coated plates were imaged with a laser device with output at 830 nm using an energy of 800 mJ/cm$^2$ and 16 Watts of power. The plate was mounted on a press and 10,000 impressions of high quality print were obtained.

EXAMPLE 8

A dispersion was made up in the same way as in the previous Example 7 consisting of 10% silver sulfamethazine, 5.0% ZnO and 0.35% polyvinyl butyral in ethanol. (polyacrylic acid (PAA) styrene-alt-maleic acid copolymer, Tyzor AA135 and dye solutions in ethanol. The following formulation was made up:—4 g silver sulfamethazine dispersion, 1 g 7.5% polyacrylic acid, 1 g 7.5% styrene-alt-maleic acid copolymer, 0.5 g 3% ADS 830A and 1 g 0.03 M Tyzor AA-135 and mixed together. The formula was manually coated using a doctor box onto anodised aluminum plates. After drying in air for 10 minutes a dry coating weight of about 2.4 g/m$^2$ was obtained. The coating was subjected to IR-laser exposure using an imaging energy of 800 mJ/cm$^2$ at 16 watts. 2,000 impressions of high quality print were obtained when the plate was printed on a Ryobi press.

EXAMPLE 9

A dispersion was made up in the same way as in the previous Example 8 except that silver behenate was used in place of silver sulfamerazine. The dispersion consisted of 10% Silver behenate, 2.5% ZnO and 0.35% polyvinyl butyral in ethanol. 1.5 g of the dispersion was mixed with 2 g 7.5% polyacrylic acid, 0.5 g 3% ADS 830A and 1 g 0.03 M Tyzor AA-135 using a magnetic stirrer The mixture was coated using a doctor box onto grained anodised aluminum plates. After drying in air for 10 minutes a coating thickness of 2.5 g/m$^2$ was obtained. The plates were exposed using an 830 nm laser device with an energy of 600 mJ/cm$^2$ at 9 watts. The plate was used to print 3,000 impressions of fair quality.

EXAMPLE 10

10% Silver toluenesulfonate, 2.5% ZnO and 0.35% polyvinyl butyral and ethanol were mixed. A dispersion of these materials was made by ball-milling the mixture for 15 hours. The following formulation was made up 2 g silver toluenesulfonate dispersion, 1 g 7.5% polyacrylic acid, 1 g 7.5% methyl vinyl ether-alt-maleic acid copolymer, 0.5 g 3% ADS 830A and 1 g 0.03 M Tyzor™ AA-135. The formula was coated using a doctor box onto grained, anodized aluminum plates. After drying for 10 minutes in air, the coated plate was subjected to IR-laser exposure. The imaging energy used was 600 mJ/cm$^2$ at 9 watts. The plate was then used to print 3,000 impressions with good print quality.

EXAMPLE 11

A dispersion of sulfadiazine 8.7% and polyvinyl butyral 0.35% in ethanol was made up by milling the materials in a ball mill for 12 hours. The following formula was made up:—3 g sulfadiazine dispersion, 3 g 7.5% polyacrylic acid, 1 g 3% ADS 830A and 3 g 0.03 M Tyzor™ AA-135. The components were mixed in a glass bottle using a magnetic stirrer, and then were coated onto grained, anodized aluminum plates that after drying in air gave a thickness of about 2.5 g/m$^2$. The coating was digitally exposed using an 830 nm IR-laser with an energy of 600 mJ/cm$^2$ with a power of 9 watts. The plate was then used to give 2,000 good quality prints.

EXAMPLE 12

A dispersion was made up by ball milling 10% ZnO and 0.35% polyvinyl butyral in ethanol. A formulation of the following was made:—1 g ZnO dispersion, 1 g 7.5% polyacrylic acid, 1 g 7.5% methyl vinyl ether-alt-maleic acid copolymer, 0.5 g 3% ADS 830A and 1.5 g 0.03 M Tyzor™ AA-135. The components were mixed in a glass bottle using a magnetic stirrer prior to coating onto anodized aluminum plates. After drying in air, the coated plates were subjected to image-wise 830 nm IR-laser exposure using energy of 600 mJ/cm$^2$ at 9 watts. On printing 3,000 impressions of high quality were reached.

EXAMPLE 13

A dispersion consisting of 10% $TiO_2$ and 0.35% polyvinyl butyral in ethanol was made by milling in a ball mill for 12 hours. A formula was made up of 1 g $TiO_2$ dispersion, 1 g 7.5% polyacrylic acid, 1 g 7.5% methyl vinyl ether-alt-maleic acid copolymer, 0.5 g 3% ADS 830A and 1.5 g 0.03M Tyzor™ AA-135. The components were mixed in a glass bottle using a magnetic stirrer, and then coated onto grained, anodized aluminum plates. After drying in air a thickness of about 2.7 g/m$^2$ was obtained. The coated plates were digitally exposed using an 830 nm IR-laser. The imaging energy was 600 mj/cm$^{2,}$ using 9 watts of power. The plate was used to print 2,000 good quality impressions on coated paper.

EXAMPLE 14

The dispersion of the previous example was used to make a formula consisting of lg $TiO_2$ dispersion, 2 g 7.5% polyacrylic acid, 0.5 g 3% ADS 830A and 1.5 g 0.03 M Tyzor™ AA-135. The components were mixed in a glass bottle by magnetic stirrer, and then coated using a doctor blade onto grained, anodized aluminum plates. After drying in air for 10 minutes a dry coating weight of 3 g/m$^2$ was produced. The coated plate was image-wise exposed using a Creo Products Inc. Trendsetter Platesetter with an energy of 600 mJ/cm$^2$, at 9 watts. The plate was mounted on a Ryobi press and 2,000 impressions of high quality were obtained.

EXAMPLE 15

A solution of 2% Tyzor™ AA135 was added to a solution of 5.4% polyacrylic acid in ethanol containing 0.27% ADS 830 A to make up 3 mols of Ti per 100 mols of carboxyl group. The solution was quickly stirred and cast onto an anodized aluminum plate. After drying the coating using a strong air flow for 5 minutes, the plate was imaged with a laser (830 nm) and used for printing. Once printing was completed, the plate was washed with an aqueous solution of 5% sodium carbonate, rinsed with water, dried, re-coated and after imaging used to print a further image. This process could be repeated a number of times.

EXAMPLE 16

Solution A was prepared containing 4% polyacrylic acid in ethanol, 0.2% ADS 830AW and titanium(IV) bis (ammonium lactato dihydroxide, I) which comes as a 50% solution in water and it was added to a concentration of 3 mols Ti/100 mols $CO_2H$. A solution B was prepared by adding Tyzor™ TE (80% titanium salt in isopropyl alcohol) to ethanol in a concentration that would ensure 1.5 mols Ti/100 $CO_2H$ when solutions A and B were mixed in a proportion of 1:1. The two solutions were fed into a spraying gun and mixed in the nozzle just before spraying on an anodized aluminum printing plate. The plate was imaged and then used to print, after which the coating was washed off in 5% aqueous sodium carbonate and the plate re-coated. Crosslinker I was active during laser imaging, while crosslinker II ensures background crosslinking.

EXAMPLE 17

A mixed solution of polyacrylic acid and poly(vinyl methyl-alt-maleic acid) of Molecular Weight 350K (the terminology of MW350K will be used to identify such molecular weights) was prepared with a total concentration of 5.4% solids in ethanol and a weight ratio of 1:1 of the two polymers. A solution of the polymethine dye Sands 3984 in ethanol was added to the above polymer solution to have a dye concentration of 0.216%. Then a solution of 2% Tyzor™ AA75 in ethanol was added to a final concentration of 3% mols Ti per 100 mols carboxyl. The solution was quickly stirred and cast on a aluminum plate. After quick evaporation under a strong air flow, the plate was imaged with laser (830 nm) and used for printing. Once the printing job was complete, the coating on the plate was removed by washing with a solution of 5% sodium carbonate. The substrate was rinsed with water, dried and re-coated. The new coating was used as a printing master. The cycle could be repeated for a number of times.

EXAMPLE 18

A solution of polyacrylic acid of MW150K was prepared with a total concentration of 5.4% solids in ethanol. A solution of the ADS 830A dye in ethanol was added to the above polymer solution to give a dye concentration of 0.216%. An anodized aluminum surface was primed with a solution of Tyzor™ AA75 to give a thickness of less than 0.5 g/square meter. A solution of 2% Tyzor™ AA75 in ethanol was mixed in an in-line mixer and then sprayed onto the primed surface of the substrate which was mounted on an SM74 printing press. The coating had a final concentration of 3% mols Ti per 100 mols carboxyl and a coating weight of 2 g/square meter. The coating was dried using a strong flow of air at room temperature. The plate was imaged with a laser (830 nm) and used for printing. Once the printing job completed at 1000 impressions, the plate was cleaned of ink using a blanket wash. The coating was sprayed with a solution of 5% sodium carbonate, the coating was removed using a pressure washer containing water. The plate substrate was dried and re-coated. A new image was created in the coating and this was used as a printing master 5000 good impressions were obtained from the printing master. The above cycle could be repeated for a number of times without deterioration in the printing quality.

EXAMPLE 19

Solution A was prepared containing 4% solids as a 90:10–70:30 mixture of polyacrylic acid and poly (butadiene-co-acrylic acid) (30% solution in water and having a monomer ratio of 1:1). Solution B contained dye, Sands 3984, in a concentration of 0.16% and Tyzor™ TE in ethanol in a concentration that ensured a Ti concentration of 2–3 mols Ti/100 $CO_2H$ groups after mixing solutions A and B in a 1:1 volumetric ratio. The two solutions were mixed in the nozzle of the spraying gun. A plate was coated, imaged and printed for 500 impressions, then washed and re-coated as in the previous example.

EXAMPLE 20

A dispersion was prepared by mixing 30 g of zinc sulfadiazine, 21 g 5% polyvinyl butyral solution in ethanol, and 234 g of ethanol. This was passed three times thorough a microfluidizer to give a stable white dispersion. A coating solution was prepared by mixing 3,36 g of dispersion with 1.45 g of 7.5% polyacrylic acid, 2.11 g of 1% infrared dye solution (830A ADS), 1.14 g of ethanol. This was coated on the anodized side of the lithographic printing plate using a knife coater at 3 mils wet. The sample was dried for 2 minutes at 60 C. The resulting printing plate was imaged with a Creo Trendsetter at 11 watts and 600 mJ/cm2. This plate was printed using a Ryobi printing press giving sharp images showing 1–97% dots at 200 lpi. The plate printed 1000 impression with no visible signs of wear.

EXAMPLES 21–27

Plate Formulations

The procedure used was to make a dispersion of each metal sulfa derivative by taking 15 grams of each, 7.5 grams of ZnO and 10.5 grams of 5% polyvinyl butyral solution in ethanol and 117 grams of ethanol. This was ball milled with glass marble for 18–24 hours to form a stable dispersion. The procedure made a dispersion of each metal sulfa derivative by taking 15 grams of each, 7.5 grams of ZnO and 10.5 grams of 5% polyvinyl solution in ethanol and 117 grams of ethanol. This was ball milled with glass marble for 18–24 hours to form a stable dispersion. Each dispersion was formulating into a part A of a coating by mixing 16.1 grams of dispersion with 0.8 grams of a 5% acetic acid/water, 5.3 grams of water and 15.7 grams of isopropyl alcohol. The part B resin solution was prepared by using 22.6 grams of 7.5% ethanol solution of polyacrylic acid, 18.3 grams of 2% ethanol solution of infra red absorbing dye 830A and 112 grams of ethanol. Just prior to coating, the two solutions were mixed in a one to one ratio, coated on aluminum sheet, and dried with hot 75 degree C. air to give a dry coating weight of 3 grams per square meter. Each dispersion was formulating into part A of a coating by mixing 16.1 grams of dispersion with 0.8 grams of a 5% acetic acid /water, 5.3 grams of water and 15.7 grams of isopropyl alcohol. Part B resin solution was mixed using 22.6 grams of 7.5% ethanol solution of polyacrylic acid, 18.3 grams of 2% ethanol solution of infra red absorbing dye 830A and 112 grams of ethanol. Just prior to coating, the two solutions were mixed in a one to one ratio, coated on aluminum sheet, and dried with hot 75 degree C. air to give a dry coating weight of 3 grams per square meter.

Imaging and Print Results

The plates were imaged with a Creo Trendsetter platesetter using 830 nm laser diode array run at 12 watts. The best images were achieved at the following energies.

| | | |
|---|---|---|
| Silver sulfadiazine | 1500 mJ/cm$^2$ | Ran very clean. |
| Silver sulfamerazine | 400 | Ran very clean |
| Silver sulfamethazine | 400 | Ran very clean |
| Silver sulfamethazine | 400 | Ran very clean |
| Silver sulfamethoxazole | 300 | Began clean but ran with slight increasing scum |
| Iron sulfadiazine | 800 | Ran with slight scum |
| Copper sulfadiazine | 500 | Ran very clean |

These were evaluated by running on a Ryobi single color printing press. All demonstrated good hydrophobic/hydrophilic balance with the imaged area taking the ink. All of the plates rolled up within 30 prints and were able print out to 3,000 except the iron sulfadiazine that showed marginal printing performance.

COMPARATIVE EXAMPLE 28

A dispersion was made by taking 15 grams sulfadiazine, 7.5 grams of ZnO and 10.5 grams of 5% polyvinyl butyral solution in ethanol and 117 grams of ethanol. This mixture was ball milled with glass marble for 18–24 hours to form a stable dispersion. Each dispersion was formulating into part A of a coating by mixing 16.1 grams of dispersion with 0.8 grams of a 5% acetic acid/water, 5.3 grams of water and 15.7 grams of isopropyl alcohol. Part B resin solution was mixed using 22.6 grams of 7.5% ethanol solution of polyacrylic acid, 18.3 grams of 2% ethanol solution of infra red absorbing dye 830A and 112 grams of ethanol. Just prior to coating, the two solutions were mixed in a one to one ratio. The resultant solution was coated onto aluminum sheet, and dried with air at 75° C. A dry coating weight of 3 grams/square meter was obtained.

The plate was imaged with a Creo Trendsetter platesetter using an 830 nm laser diode device. The plate was imaged using 12 Watts and 1500 mJ/cm squared. This is the same energy as was used for the silver sulfadiazine. An image appeared on the plate during the imaging step but when the plate was mounted on the Ryobi press there was no differential in oleophilicity between the image and non-image areas. The plate would not take ink.

EXAMPLE 29

A dispersion was prepared of polyacrylic acid hydroxyethyl acrylate copolymer 95:5, 40%, silver behenate 56% and ADS 830A 4% in methylethyl ketone to give a solids content of 4%. The mixture was ball-milled using glass marbles overnight. A solution of hexamethylene diisocyanate in methylethyl ketone was added to the dispersion so that equimolar isocyanate function to hydroxyl function was obtained and the mixture knife coated onto a grained anodized aluminum sheet. After the solvent had dried, the coating was imaged using an infra red laser with an energy of 400 mJ at 10Watts. The coating was not removed using 50 double wipes with fountain solution and 5% isopropanol. An inked image was formed when wiped with lithographic ink. The non-image areas did not take ink.

What is claimed:

1. A printing plate precursor comprising a substrate having coated thereon a dried layer that becomes less hydrophilic upon exposure to radiation that effects crosslinking in the layer, the layer comprising a mixture of a crosslinkable polymer and a crosslinkable metal salt wherein the metal salt is selected from the class consisting of metal salts of sulfamide, sulfanylamide, acetosulfamine, sulfathiazole, sulfadiazine, sulfamerazine, sulfamethoxazole, sulfamethazine, sulfaisoxazole, homosulfamine, sulfisomidine, sulfaguanidine, sulfamethizole, sulfapyridine, phthalisosulfathiazole and succinylsulfathiazole and the substrate comprises aluminum.

2. The printing plate precursor of claim 1 wherein the metal salt is selected from the class consisting of metal salts of sulfadiazine, sulfamethoxazole, and sulfamerazine.

3. The printing plate precursor of claim 1 wherein the crosslinkable polymer comprises a polymer derived from an ethylenically unsaturated monomer.

4. The printing plate precursor of claim 1 wherein the polymer comprises a (meth)acrylic polymer.

5. The printing plate precursor of claim 1 wherein the crosslinkable polymer comprises a polymer derived from an ethylenically unsaturated monomer selected from the group consisting of acrylic acid, methacrylic acid, butyl acrylate, cyclohexyl acrylate, ethylhexyl acrylate, benzyl acrylate, furfuryl acrylate, ethoxyethyl acrylate, tricyclodecanyloxy acrylate, nonylphenyloxyethyl acrylate, hexanediol acrylate, 1,3-dioxolane acrylate, hexanediol diacrylate, butanediol diacrylate, neopentyl glycol diacrylate, polyethylene glycol diacrylate, isobornyl acrylate, isobornylmethacrylate, tricyclodecanedimethylol diacrylate, tripropylene glycol diacrylate, bisphenol-A diacrylate, pentaerythritol triacrylate, dipentaerythritol hexaacrylate, dipentaerythritol caprolactone adduct hexaacrylate, trimethylolpropane triacrylate, trimethylolpropane propylene oxide adduct triacrylate, polyoxyethylated bisphenol-A diacrylate, polyester acrylate and polyurethane acrylate, butyl methacrylate, cyclohexyl methacrylate, ethylhexyl methacrylate, benzyl methacrylate, furfuryl methacrylate, ethoxylethyl methacrylate, tricyclodecanyloxy methacrylate, nonylphenyloxyethyl methacrylate, hexanediol methacrylate, 1,3-dioxolane methacrylate, hexanediol dimethacrylate, butanediol dimethacrylate, neopentyl glycol dimethacrylate, polyethylene glycol dimethacrylate, tricyclodecanedimethylol dimethacrylate, tripropylene glycol dimethacrylate, bisphenol-A dimethacrylate, pentaerythritol trimethacrylate, dipentaerythritol hexamethacrylate, dipentaerythritol caprolactone adduct hexamethacrylate, trimethylolpropane trimethacrylate, trimethylolpropane propylene oxide adduct trimethacrylate, polyoxyethylated bisphenol-A dimethacrylate, polyester methacrylate and polyurethane methacrylate, pentaerythritol triacrylate, dipentaerythritol hexaacrylate, dipentaerythritol caprolactone adduct hexaacrylate, trimethylolpropane triacrylate, acetoacetoxyethyl methacrylate, acetoacetoxyethyl acrylate, and trimethylolpropane propylene oxide adduct triacrylate.

6. The printing plate precursor of claim 1 wherein the metal salt crosslinkable material comprises a metal salt of an organic compound.

7. The printing plate precursor of claim 1 wherein the metal salt crosslinkable material comprises a metal salt of a fatty acid.

8. The printing plate precursor of claim 1 wherein the metal salt crosslinkable material comprises a metal salt of a benzthiazole or benzamidazole.

9. The printing plate precursor of claim 1 wherein the metal salt crosslinkable material comprises a complexed metal salt.

10. The printing plate precursor of claim 1 wherein crosslinking reactions of the crosslinkable polymer are independent of the crosslinking of the metal salt.

11. The printing plate precursor of claim 10 wherein said metal salt is a complexed metal salt.

12. A printing plate precursor comprising a substrate having coated thereon a dried layer that becomes less hydrophilic upon exposure to radiation that effects crosslinking in the layer, the layer comprising a mixture of a crosslinkable polymer and a crosslinkable metal salt, wherein the crosslinkable metal salt comprises a metal salt of a sulfamide.

* * * * *